United States Patent [19]

Mune

[11] 4,023,127

[45] May 10, 1977

[54] CIRCUIT BREAKER WITH CONTACTS WHICH ARE NOT ENGAGEABLE WHEN THE ELECTRICAL SENSING UNIT THEREOF IS ENERGIZED

[75] Inventor: Charles Mune, Trenton, N.J.

[73] Assignee: Heinemann Electric Company, Trenton, N.J.

[22] Filed: Sept. 11, 1975

[21] Appl. No.: 612,373

[52] U.S. Cl. ..... 335/172; 335/24; 335/174

[51] Int. Cl.[2] ..... H01H 9/20; H01H 75/00

[58] Field of Search ..... 335/24, 172, 174, 166

[56] References Cited

UNITED STATES PATENTS

| | | | |
|---|---|---|---|
| 3,273,089 | 9/1966 | Franz | 335/166 |
| 3,329,913 | 7/1967 | Camp | 335/174 |

*Primary Examiner*—Harold Broome
*Attorney, Agent, or Firm*—Joseph G. Denny, III; Peter J. Patane

[57] ABSTRACT

A circuit breaker with contacts which are not engageable when the electrical sensing unit thereof is energized above a predetermined level (at which the contacts would be tripped open if closed) even though the handle of the linkage mechanism of the circuit breaker is moved to the contacts closed (or contacts engaged) position.

9 Claims, 9 Drawing Figures

FIG. 1
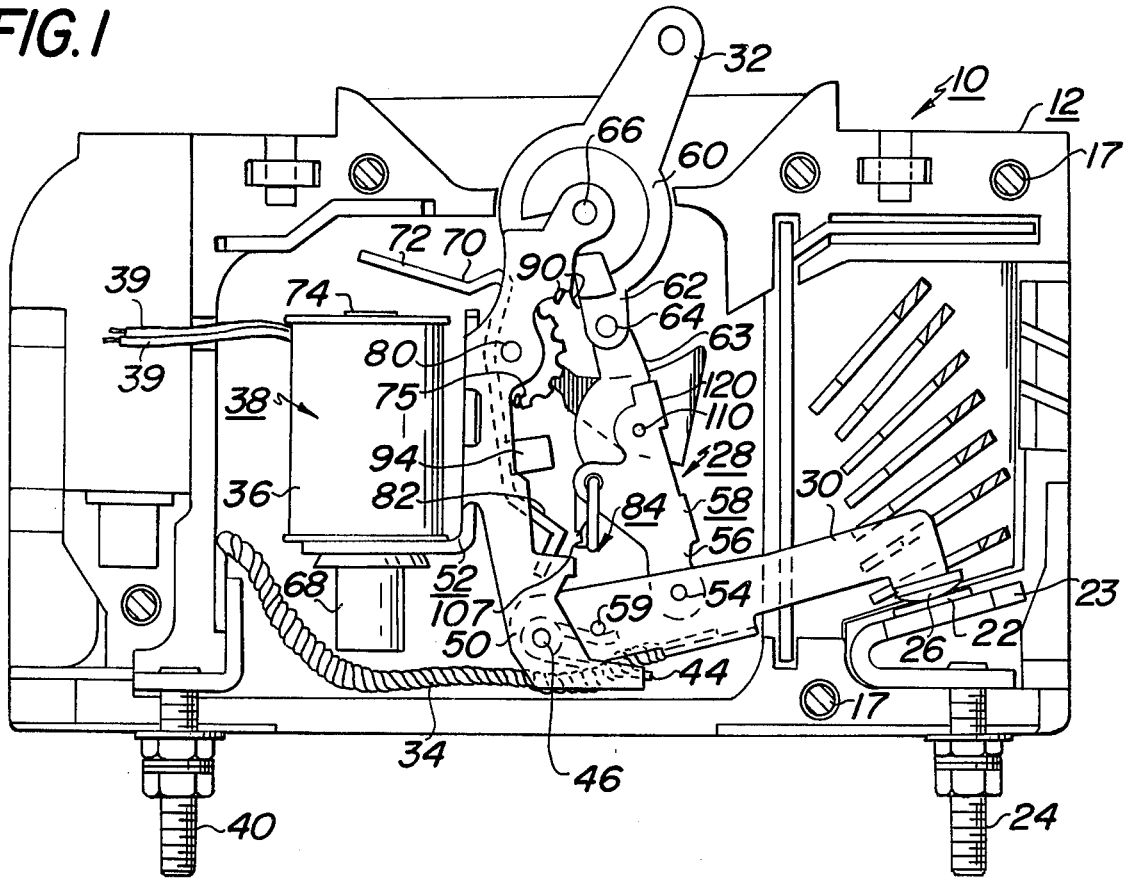
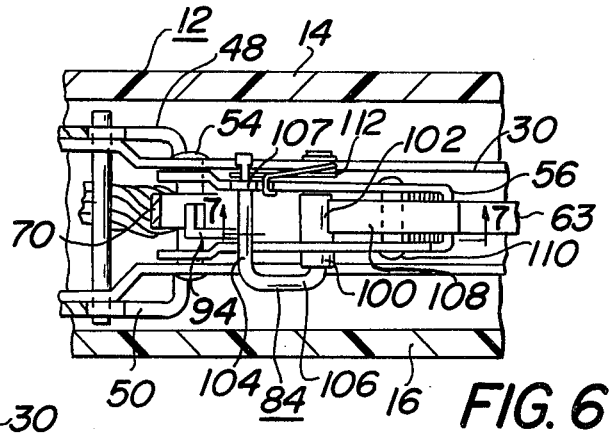
FIG. 6
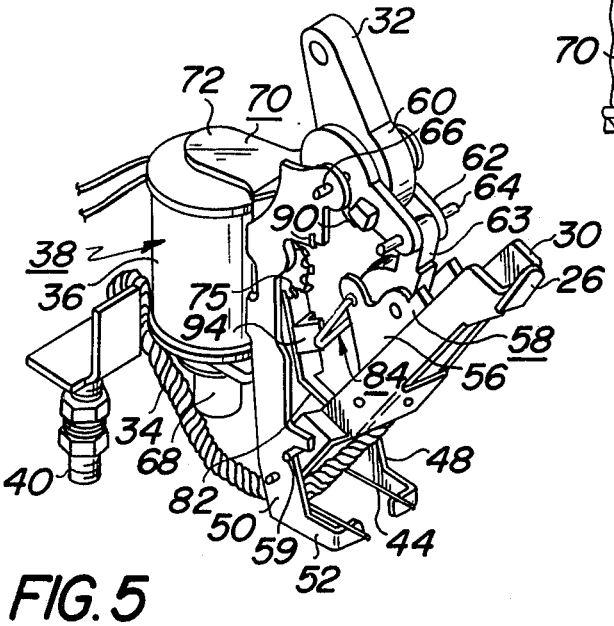
FIG. 5
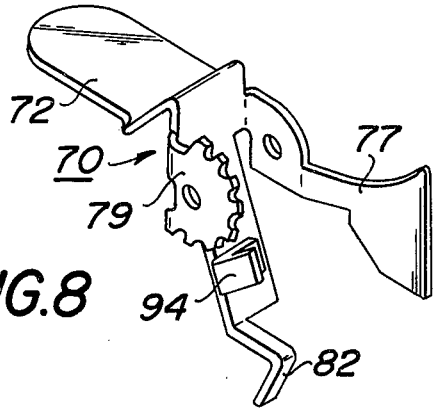
FIG. 8

FIG. 2
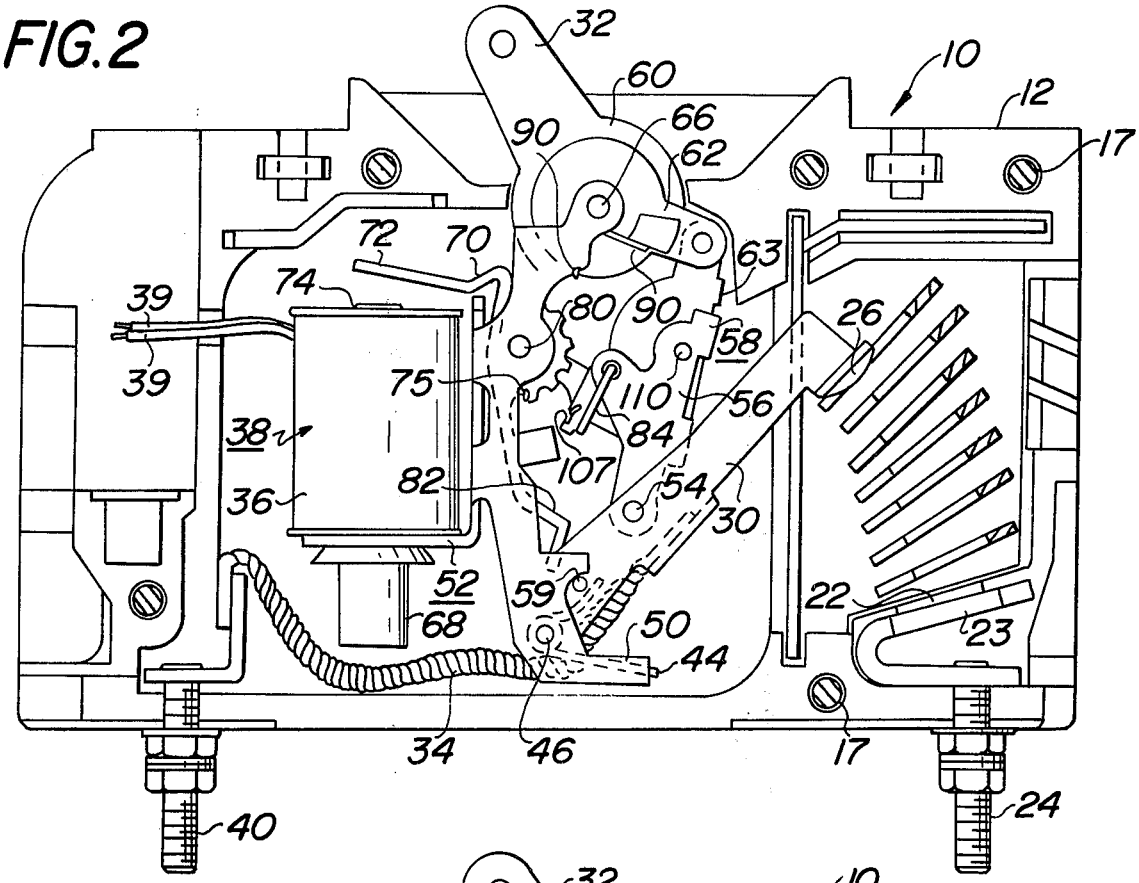
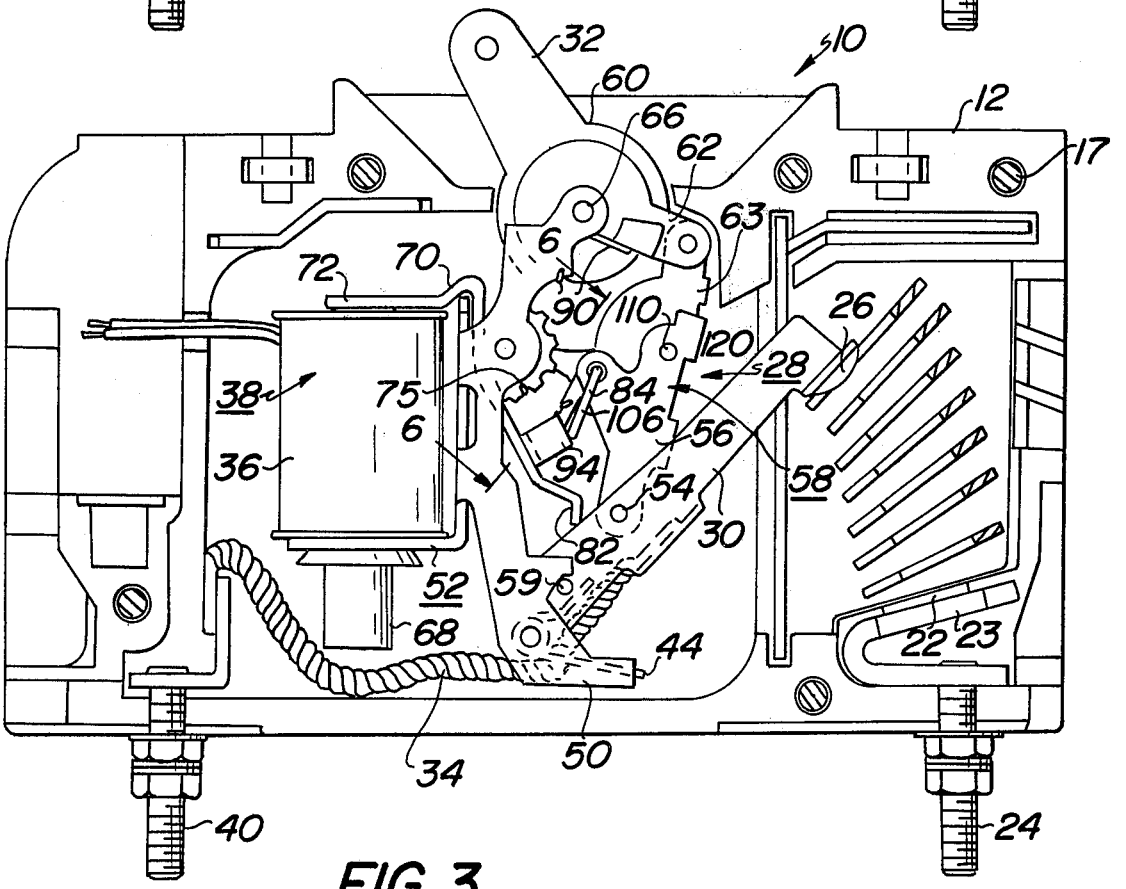
FIG. 3

FIG. 4
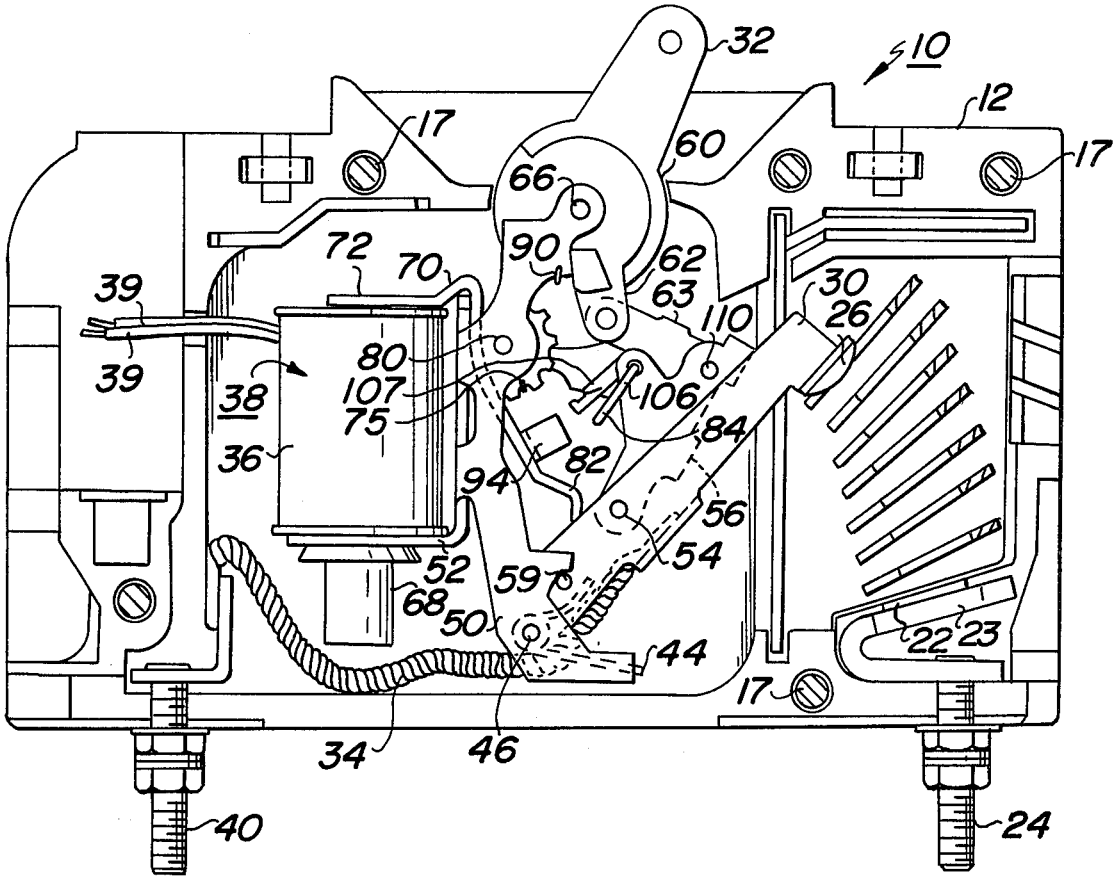
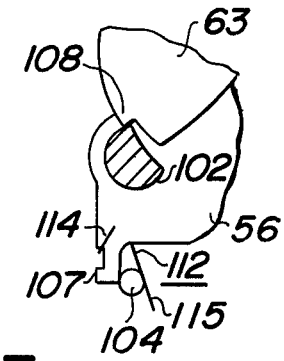
FIG. 7
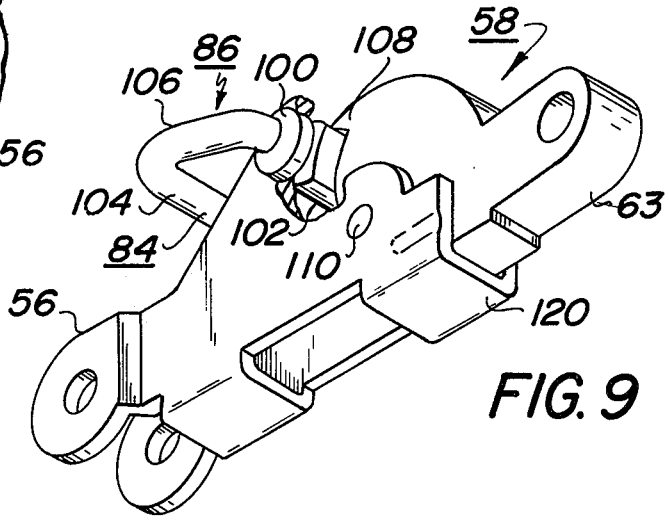
FIG. 9

CIRCUIT BREAKER WITH CONTACTS WHICH ARE NOT ENGAGEABLE WHEN THE ELECTRICAL SENSING UNIT THEREOF IS ENERGIZED

BACKGROUND OF THE INVENTION

This invention relates generally to electric circuit breakers with elecrical sensing units of the electromagnetic type in which the electrical sensing unit is in a circuit separate from the electrical circuit of the circuit breaker contacts. Such circuit breakerss are commonly known as "relay type circuit breakers". More particularly, this invention relates to relay type circuit breakers having linkage mechanisms with contacts which are not engageable when the electrical sensing units thereof are energized above predetermined levels, even though the linkage mechanisms are moved to the contacts closed positions. This type of linkage mechanism is generally known in the art as a "trip free" linkage mechanism and the circuit breaker is known as a "trip free circuit breaker".

Many circuit breakers are known and shown in the prior art having trip free mechanisms. For example, U.S. Pat. Nos. 3,329,913 and 3,273,089 (both assigned to the Heinemann Electric Company) illustrate circuit breakers with such mechanisms.

Electromagnetic circuit breakers with such trip free mechanisms typically comprise a movable contact, mounted on a movable arm, and a stationary contact. The circuit breaker also includes a linkage mechanism having an operating handle and a movable arm on which the movable contact is mounted. The linkage mechanism further includes a collapsible toggle assembly, the latter including a locking or latching device. The movable and stationary contacts are opened or closed by pivoting back and forth the operating handle which then moves the movable contact toward engagement or away from engagement with the stationary contact.

The electromagnetic device includes a coil and an armature which (upon predetermined energization of the coil) moves to an actuated position. The armature includes a portion which in the actuated position engages and rotates the locking device, unlatching the latter, whereupon the toggle assembly collapses and the contacts open.

As long as the coil is energized above the predetermined level, the armature remains in its actuated position, and any attempt to reclose the contacts will move the locking device into engagement with the armature, causing the toggle assembly to again collapse, whereupon it is usually not possible to complete the movement of the movable arm toward the contacts closed position. Instead, the movable arm moves to the contacts open position under the bias of a spring which tends to bias the movable arm to its contacts open position.

While the foregoing is the "usual" sequence in the prior art devices, it has been found that because of the inertia of the movable arm and the associated collapsible toggle assembly, if a sufficient force is applied to the operator, the movable arm sometimes attains sufficient momentum to continue its travel toward the stationary contact, even after the locking device has been unlatched by the armature, causing the movable and stationary contacts to momentarily touch each other and thereafter to separate. This momentary reclosing of the contacts may be undesirable and may even damage the load connected to the circuit breaker.

BRIEF SUMMARY OF THE INVENTION

Thus, it is an object of this invention to provide a relay type circuit breaker with a mechanism which cannot be manually reclosed, even momentarily, when the electromagnetic sensing device is energized above the predetermined level at which the contacts would open, if closed.

This invention provides a relay type circuit breaker comprising a case having a stationary contact mounted within the case and movable into and out of engagement with the stationary contact. The mechanism for manually opening and closing the contacts and for electrically tripping "open" the contacts on predetermined conditions, in addition to the movable arm, comprises a handle pivotally mounted within the case and a collapsible toggle linkage for interconnecting the handle and the movable arm. The collapsible toggle linkage includes a locking (or latching) device for maintaining it rigid, the locking device being spring biased to the locking or reset position. An electromagnetic sensing device including a coil and an armature is provided for unlatching the locking device of the collapsible toggle linkage upon predetermined electrical conditions, whereupon the toggle linkage collapses and moves the contacts from the contacts "closed" position to the contacts open position. The coil and the contacts of the circuit breaker are in electrically separate circuits.

The electromagnetic sensing device is constructed so that different portions of the armature engage the locking device of the collapsible toggle linkage upon predetermined energization of the coil, one portion of the armature engaging the locking device when the contacts are closed and another portion of the armature engaging the locking device when the contacts are open, thereby causing the linkage to collapse when in the contacts closed position and further preventing the locking device from resetting itself to the locked position so as to prevent the linkage from being moved toward the contacts closed position, so long as the coil is energized above the predetermined level.

The foregoing and other objects of the invention, the principles of the invention and the best mode in which I have contemplated applying such principles will more fully appear from the following description and accompanying drawings in illustration thereof.

BRIEF DESCRIPTION OF THE VIEWS

In the drawings:

FIG. 1 is a side elevation view, with one half-case removed, of a relay type circuit breaker incorporating the present invention, the circuit breaker being shown in the contacts closed position;

FIG. 2 is a side elevation view, similar to FIG. 1, but showing the contacts open position and the handle in the off position;

FIG. 3 is a side elevation view, similar to FIG. 1, but showing the electrically tripped open position of the contacts with the handle in the off position;

FIG. 4 is a side elevation view, similar to FIG. 3, but showing the toggle linkage and the handle prior to resetting of the handle to its off position;

FIG. 5 is a perspective view of the mechanism of the circuit breaker shown in FIGS. 1 to 4, omitting the half-cases;

FIG. 6 is a partial sectional view taken along the line 6—6 in FIG. 3;

FIG. 7 is a partial sectional view taken along the line 7—7 in FIG. 6;

FIG. 8 is a top, perspective view of the armature of the circuit breaker shown in FIGS. 1 to 4; and FIG. 9 is a bottom perspective view of the toggle mechanism showing a part of it cut away for illustrative purposes.

DESCRIPTION OF THE PREFERRED EMBODIMENT

Referring to the drawings, the circuit breaker 10 comprises an insulating case 12, preferably molded from a plastic material, divided into two juxtaposed, approximately half-cases 14 and 16, partially shown in FIG. 6, secured together by suitable rivets 17, FIG. 1. The circuit breaker 10 includes a stationary contact 22 (carried by a supporting conductor 23 forming part of a terminal 24) and a movable contact 26. The circuit breaker further comprises a mechanism 28 including a movable arm 30 carrying the movable contact 26. The mechanism 28 also includes an operator or handle 32 which extends out of the case 12, as shown, to manually open and close the contacts 22 and 26.

The movable arm 30 is connected by a flexible conductor 34 to a terminal 40. A coil 36 forms part of an electromagnetic sensing device 38 (which is also enclosed by the case 12). The sensing device 38 also comprises part of the mechanism 28 to trip open the contacts on predetermined energization of the coil 36. The coil 36 leads 39 which extend outwardly of the case 12 through a suitable slot, as shown, to be connected to a suitable source.

Further, the movable arm 30 is biased by a spring 44 toward the open position of the contacts 22 and 26 and the movable arm 30 is mounted on a pin 46 about which it pivots, the pin 46 having end portions carried by two spaced plates 48 and 50 (FIG. 5) forming a frame 52, only the plate 50 being shown in FIG. 1. The movable arm 30 is also connected by a pin 54 to the lower link 56 of a collapsible toggle mechanism 58, the latter also comprising part of the mechanism 28. Further, the movable arm 30 carries a stop pin 59 which abuts with the spaced frame plates 48 and 50, FIGS. 2, 3 and 4, to limit counterclockwise movement of the arm 30.

The handle 32 is part of a handle line 60 which also includes an arm 62, the upper link 63 of the collapsible toggle mechanism 58 being connected to the arm 62 by a pin 64. The handle link 60 is mounted between the plates 48 and 50 and pivots about a pin 66 having end portions carried by the spaced plates 48 and 50.

The frame plates 48 and 50 are integral with the L-shaped magnetic frame 52 forming part of the electromagnetic device 38 and to which is secured a time delay tube 68 housing a spring biased magnetizable core (not illustrated) movable against the retarding action of a suitable fluid. When the coil 36 is energized above a predetermined level, but below a higher level, the magnetizable core (not illustrated) moves toward a pole piece 74 to increase the electromagnetic force on an armature 70. After a time delay period the electromagnetic force is sufficient to actuate it from the position of FIG. 1 to the positions of FIGS. 3 and 4, whereupon tripping of the collapsible toggle mechanism 58 takes place. Actuation of the armature 70 takes place without such time delay when the coil 36 is energized above the mentioned higher level, of course, as is known in the prior art, if the coil 36 is energized at a sufficiently high level the armature 70 will be attracted to the pole piece 7 without a time delay period, i.e., virtually instantaneously.

The construction and operation of this type of mechanism 58 and associated electromagnetic sensing device 38 is generally set forth in U.S. Pat. Nos. 2,360,922 and 3,329,913 among others, but for clarity's sake may be briefly described as follows—when the handle 32 is rotated clockwise, as viewed in FIG. 2, the collapsible toggle mechanism 58 and the movable arm 30 all move down, against the bias of the spring 44, and move the movable contact 26 into engagement with the stationary contact 22, the contacts assuming the closed position illustrated in FIG. 1.

Upon sufficient energization of the coil 36, assuming the circuit breaker to be in the contacts closed position of FIG. 1, the leg 72 of the armature 70 (which is also part of the electromagnetic device 38) is attracted toward the pole piece 74. The armature leg 72 moves toward the pole piece 74 at such time, the armature 70 pivoting to the positions of FIGS. 3 and 4 about a pin 80 having end portions carried by the spaced frame plates 48 and 50. The armature 72 includes a trip member 82 which pivots counterclockwise (as viewed in FIG. 1) to engage and rotate a latch pintle 84 forming part of a locking device or latch 86, rotation of the latch pintle 84 causing the locking device or latch 86 to unlatch, whereupon the toggle mechanism 58 collapses under the pressure of the opening spring 44. The armature 70 also includes a balance arm 77 and a serrated ear 79 both well known in the prior art, the former to balance the armature 70 and the latter to adjust the tension on the spring 75 for biasing the armature 70 clockwise, only one end portion of the spring 75 being shown in FIGS. 2 and 3, for example.

The latch pintle 84 has a U-shape and comprises a latching leg 100 having a half-moon 102 defined by a convex surface and a flat surface, the latching leg 100 being connected to a tripping leg 104 by a base 106. The latch pintle 84 is carried by its latching leg 100 in suitable bearings formed in the lower or carrier toggle link 56 and the convex surface of the half-moon portion 102 is engageable with a tooth 108 formed on the upper or catch toggle link 63, the links 56 and 63 being pivotally connected by a pintle 110. Further, as shown in FIG. 6, a spring 112 is coiled about the latching leg 100 with one spring end 114 (FIG. 7) bent over an edge stop portion 107 of the lower (carrier) link 56 and another spring end portion 115 overlying and engaging the tripping leg 104 to bias the latch pintle 84 clockwise, as viewed in FIG. 7, against the edge stop portion 107 and to present to the tooth 108 the convex side of the half-moon portion 102 to latch the toggle links 56 and 63 rigidly together, movement of the tripping leg 104 in the clockwise direction (toward the tripping arm 82) being limited by the stop 107 formed on the lower (carrier) link 56.

Further, the toggle links 56 and 63 are positioned relative to the armature trip arm 82 so that when the contacts 22 and 26 are closed, the trip arm 82 is directly behind (or to the left in FIG. 1) of the tripping leg 104 and upon sufficient pivotal movement of the armature leg 72 toward the pole 74, the trip arm 82 engages the tripping leg 104 and pivots the half-moon portion 102 sufficiently for the flat surface of the latter to be presented to the tooth 108, at which time the toggle links 56 and 63 collapse automatically under pressure of the opening spring 44 and the contacts move to the open position.

As shown by a comparison of FIGS. 1 and 2, when the mechanism 28 is in the contacts closed position, the latch pintle 84 is juxtaposed with the trip member 82 and with the tripping leg 104 in the path of the trip member 82 when the latter is pivoted to the right (when the armature leg 72 moves toward the pole piece 74). When the mechanism 28 moves to the contacts open position shown in FIGS. 2 and 3, the latch pintle 84 has moved up and is no longer in the path of the trip member 82, but the tripping leg 104 (of latch pintle 84) is now instead in the path of a projection or lever 94 provided by this invention. The projection 94 is carried by the armature 70 between the pin 80 and the trip member 82, as shown, but could be made an integral part of the armature 70.

Referring to FIG. 3, with the armature leg 72 attracted to the pole piece 74, any rotation of the handle 32 from the position of FIG. 3 to the position of FIG. 4 will merely collapse the toggle mechanism 28 to the position shown in FIG. 4, without moving the movable arm 30, because the toggle mechanism 28 is unlocked and in a non-force transmitting arrangement, due to the tooth 108 not being caught on the half-moon shaft 102.

Thus, the armature projection 94 provides (together with the coil 36) an auxiliary arrangement for pivoting the U-shaped latch pintle 84 (when the coil 36 is energized sufficiently to pivot the armature 70 to the position shown in FIG. 3).

As indicated, when the coil 36 is sufficiently energized, the armature leg 72 is attracted to the pole piece 74 and the armature 70 rotates to the position shown in FIGS. 3 and 4. During such movement of the armature 70, its trip member 82 engages and pivots the tripping leg 104 which unlatches the half-moon shaft 102 from the tooth 108, whereupon the toggle mechanism 58 collapses and the movable arm 30 moves from the position shown in FIG. 1 to that shown in FIGS. 2, 3 and 4.

The handle link 60 also rotates counterclockwise at such time under pressure of a handle reset spring 90 which is carried about the pin 66 and between the handle link 60 and the frame plate 50, the spring 90 being partially shown in FIGS. 1 to 5 and having one end hooked around the frame plate 50 and its other end biased against a stop projection formed on the handle arm 62. The counterclockwise rotation of the handle link 60 also pivots and raises the toggle links 56 and 63 resetting them in the position in which the tooth 108 engages the convex surface of the half-moon shaft 102, movement of the links 56 and 63 during such resetting being limited by a flange 120 integral with the link 56.

From the foregoing it is seen that manual opening and closing of the circuit breaker, and electrical tripping thereof, is accomplished as in the prior art, the armature projection 94 not being involved in the operation of the circuit breaker at such time, as it is spaced from the other parts of the circuit breaker.

However, if the coil 36 is energized sufficiently to maintain the armature 70 in the position shown in FIG. 3, after the contacts 22 and 26 are opened, the armature projection 94 now engages the tripping leg 104 and turns it sufficiently for the tooth 108 to clear the half-moon shaft 102, whereby the toggle links 56 and 63 are not latched rigid. Any attempt to reclose the contacts 22 and 26 by movement of the handle 32 from the off position of FIG. 3 to the on position of FIG. 1 will not succeed, at such time, because the collapsed toggle links 56 and 63 cannot transmit the force applied to the handle 32 to the movable arm 30.

If subsequently the coil 36 is deenergized (or energized below the predetermined level), the armature leg 72 will move away from the pole piece 74 under bias of the armature spring 75 (as is well known in the prior art) which tends to rotate the armature clockwise, as viewed in FIGS. 1 to 4, and the projection 94 will then move clockwise away from and releasing the tripping leg 104. When the tripping leg 104 is so released, it will rotate clockwise under pressure of its biasing spring 112 (FIGS. 6 and 7), turning the half-moon shaft 102 to the position where it will engage the tooth 108, making the toggle links 56 and 63 rigid once more, so as to be able to transmit any force on the handle 32 tending to move it clockwise to the movable arm 30 for closing of the contacts 22 and 26.

It is seen from the foregoing that the armature 70 includes two projections, i.e., the trip member 82 and the projection 94. When the contacts are closed and the armature 70 is unattracted to the pole piece 74, neither the trip member 82 nor the projection 94 engages the collapsible toggle linkage mechanism 58 and at such time the contacts 22 and 26 may be manually opened and closed, as desired.

Thus, it is seen that when the contacts 22 and 26 are closed, if the coil 36 is energized sufficiently to attract the armature 70 and cause it to move to the position illustrated in FIGS. 3 and 4, the trip member 82 engages the tripping leg 104 to rotate the latter, whereupon the tooth 108 disengages from the half-moon shaft 102 and the toggle linkage mechanism 58 collapses under pressure of the opening spring 44. If the energization of the coil 36 persists, the armature 70 is retained in its actuated position of FIG. 3, and the tripping leg 104 is in engagement with the projection 94 which restrains the tripping leg 104 from rotating to a position where the tooth 108 would engage the half-moon shaft 102 to relatch the toggle mechanism 58. Since relatching of the tooth 108 with the half-moon shaft 102 is thus prevented, the toggle mechanism 58 remains collapsed and any effort to rotate the handle 32 from the off to the on positions will only cause the links 56 and 63 to pivot relative to each other with no force being transferred to the movable arm 30 and, hence, no movement of the movable arm 30 takes place at such time. Thus, so long as the coil 36 is energized above the level which will cause the armature 70 to attain (or remain) in the position illustrated in FIG. 3, it is not possible to close the contacts 22 and 26, not even momentarily, and any load connected to the terminals 24 and 40 is thus protected from being even momentarily energized.

Having described this invention, what I claim is:

1. A circuit breaker comprising a case, a stationary contact mounted within said case, a movable contact within said case and movable into and out of engagement with said stationary contact, a mechanism for moving said movable contact to the contacts closed and contacts open positions and for electrically tripping open said contacts on predetermined electrical conditions comprising an operator pivotally mounted within said case a collapsible linkage interconnecting said operator and said movable contact, said collapsible linkage including a locking device maintaining said linkage rigid when said locking device is latched, electromagnetic means for collapsing said collapsible linkage upon predetermined electrical conditions to move said contacts from the contacts closed position to the contacts open position, said electromagmetic means including an armature movable upon predetermined electrical conditions to an actuated position, and said armature including first means for collapsing said collapsible linkage upon predetermined electrical conditions and second means restraining said locking device from relatching when said armature is in its actuated position and said collapsible linkage has moved toward the contacts open position to the maximum extent possible but for said second means.

2. The structure of claim 1 wherein said second means includes a projection which extends toward said locking device, said projection engaging said locking device and preventing the latter from relocking.

3. The structure recited in claim 2 wherein said first means includes another projection which engages said locking device and unlocks the latter when the contacts are closed and upon predetermined electrical conditions.

4. The structure recited in claim 1 wherein said movable contact is mounted on a movable arm, said collapsible linkage comprises a toggle having a first link connected to said operator and a second link connected to said movable arm, and said locking device comprises a half-moon shaft pivotally carried by said second link and a latching tooth formed on said first link.

5. A circuit breaker comprising a case, a stationary contact mounted within said case, a movable contact within said case and movable into and out of engagement with said stationary contact, a mechanism for moving said movable contact to the contacts closed and contacts open positions and for electrically tripping open said contacts on predetermined electrical conditions comprising an operator pivotally mounted within said case, a collapsible linkage interconnecting said operator and said movable contact, said collapsible linkage including a locking device maintaining said linkage rigid when said locking device is latched, electromagnetic means for collapsing said collapsible linkage upon predetermined electrical conditions to move said contacts from the contacts closed position to the contacts open position, said electromagnetic means including an armature movable upon predetermined electrical conditions to an actuated position, said armature restraining said locking device from relatching when said armature is in its actuated position and said collapsible linkage has moved toward the contacts open position to the maximum extent possible but for said armature, said armature including a projection which extends toward said locking device, said projection engaging said locking device and preventing the latter from relocking, and said armature also including another projection which engages said locking device and unlocks the latter when the contacts are closed and upon predetermined electrical conditions.

6. A circuit breaker comprising a case, a stationary contact mounted within said case, a movable contact within said case and movable into and out of engagement with said stationary contact, a handle mounted within said case, a linkage means connected to said handle and said movable contact, lock means for maintaining said linkage means in force transmitting position, electromagnetic means including an armature for preventing said lock means from maintaining said linkage means in force transmitting position when said electromagnetic means is sufficiently energized, said armature including a projection which extends toward said lock means, said projection engaging said lock means and preventing the latter from relocking, and said armature also including another projection which engages said lock means and unlocks the latter when the contacts are closed and upon predetermined electrical conditions.

7. A circuit breaker comprising a case, a stationary contact mounted within said case, a movable contact within said case and movable into and out of engagement with said stationary contact, a handle mounted within said case, a linkage means connected to said handle and said movable contact, lock means for maintaining said linkage means in force transmitting position, electromagnetic means including an armature for preventing said lock means from maintaining said linkage means in force transmitting position when said electromagnetic means is sufficiently energized, said movable contact is mounted on a movable arm, said linkage means comprises a toggle having a first link connected to said handle and a second link connected to said movable arm, and said locking means comprises a half-moon shaft pivotally carried by said second link and a latching tooth formed on said first link, said armature including a projection which extends toward said lock means, said projection engaging said lock means and preventing the latter from relocking, and said armature also including another projection which engages said lock means and unlocks the latter when the contacts are closed and upon predetermined electrical conditions.

8. A circuit breaker comprising a case, a stationary contact mounted within said case, a movable contact within said case and movable into and out of engagement with said stationary contact, a handle mounted within said case, a linkage means connected to said handle and said movable contact, lock means for latching and unlaching said linkage means into and out of force transmitting positions, electromagnetic means including an armature means actuatable to a position for preventing said lock means from relatching into the force transmitting position after said linkage is unlatched and while said electromagnetic means is sufficiently energized to keep said armature means in the actuated position, said armature means including a projection which extends toward said lock means, said projection engaging said lock means and preventing the latter from relocking, and said armature means including another projection which engages said lock means and unlocks the latter when the contacts are closed and upon predetermined electrical conditions.

9. The structure recited in claim 8 wherein said movable contact is mounted on a movable arm, said linkage means comprises a toggle having a first link connected to said handle and a second link connected to said movable arm, and said lock means comprises a half-moon shaft pivotally carried by said second link and a latching tooth formed on said first link.

* * * * *